United States Patent [19]

Møller

[11] Patent Number: 4,669,655

[45] Date of Patent: Jun. 2, 1987

[54] VENT CONTROL UNIT FOR A RADIATOR IN A ONE PIPE TYPE STEAM HEATING SYSTEM

[75] Inventor: Geert L. Møller, Nordborg, Denmark

[73] Assignee: Danfoss A/S, Nordborg, Denmark

[21] Appl. No.: 826,221

[22] Filed: Feb. 5, 1986

[51] Int. Cl.[4] ..... F28F 27/00

[52] U.S. Cl. ..... 236/64

[58] Field of Search ..... 236/61-66

[56] References Cited

U.S. PATENT DOCUMENTS

| | | | |
|---|---|---|---|
| 1,847,053 | 2/1932 | Brown | 236/63 |
| 2,545,107 | 3/1951 | Peper | 236/64 X |
| 3,410,485 | 11/1968 | Sullivan | 236/61 |
| 3,735,922 | 5/1973 | Fujiwara | 236/66 |
| 3,963,177 | 6/1976 | Frank | 236/64 X |

*Primary Examiner*—William E. Tapolcai

*Attorney, Agent, or Firm*—Wayne B. Easton

[57] ABSTRACT

The invention relates to a steam heating system and particularly to a vent control unit for a radiator in a one pipe type steam heating system. The vent control unit includes a thermostatically controlled valve for modulatingly venting air from the radiator to control the entrance of steam into the radiator in accordance with the heating requirements of the room. A check valve which bypasses the thermostatically controlled valve is provided to insure the admittance of air to the radiator during certain light heating conditions when the thermostatically controlled valve may be closed during a period when air must be admitted to the radiator to facilitate proper operating conditions.

1 Claim, 2 Drawing Figures

VENT CONTROL UNIT FOR A RADIATOR IN A ONE PIPE TYPE STEAM HEATING SYSTEM

Figure 1:
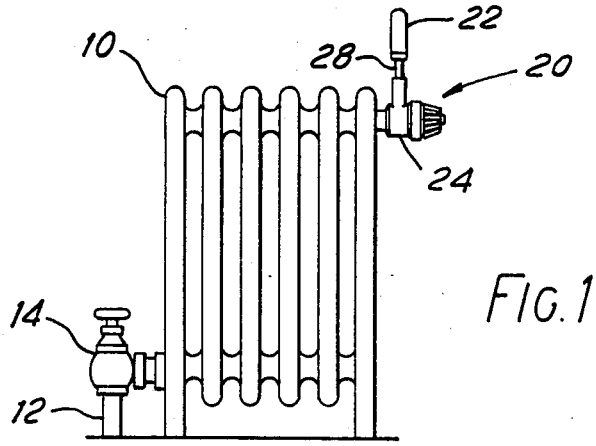

The invention relates to a steam heating system and particularly to a vent control unit for a radiator in a one pipe type system.

In the one pipe type steam heating system each room radiator in the system is connected to the boiler or other source of steam by a single pipe. The heating system has "on" and "off" periods when steam is supplied by the source during the "on" periods and condensate is drained from the radiators during the "off" periods. Typically such a system may have twenty minutes average "on" times and thirty minutes average "off" times, for example.

Each radiator has a thermostatically controlled venting unit having a valve which. is normally open during the "off" periods and modulatingly controls the venting of air from the radiator during "on" periods in accordance with the heat requirements of the room. During an "off" period the steam in the radiator condenses and the condensate returns to the source through the same pipe through which the steam was admitted. The condensing of the steam creates a partial vacuum in the radiator and air is admitted through the normally open valve in the venting unit.

During the subsequent "on" period the air in the radiator presents a barrier to the entrance of steam to the radiator. The thermostatically controlled venting unit controls the entrance of steam to the radiator by controlling the venting of the air from the radiator to make way for the steam.

A problem with the above described system is that during a time of light heat demand the valve of the venting unit might be fully closed at the end of an "on" period and stay closed during the subsequent "off" period. In that case the partial vacuum caused by the condensing steam in the radiator would not be effective to draw air into the radiator which is required for control purposes. During the subsequent "on" period there would be no air barrier to the entrance of steam into the radiator and the radiator would completely fill with steam with an accompanying complete loss of control during that "on" period.

It is a main object of the present invention to provide a new and improved vent control unit for a radiator in a one pipe steam heating system in which the above described operational difficulties are avoided.

Other objects of the invention will become apparent from the following specification, drawing and claim.

Figure 2:
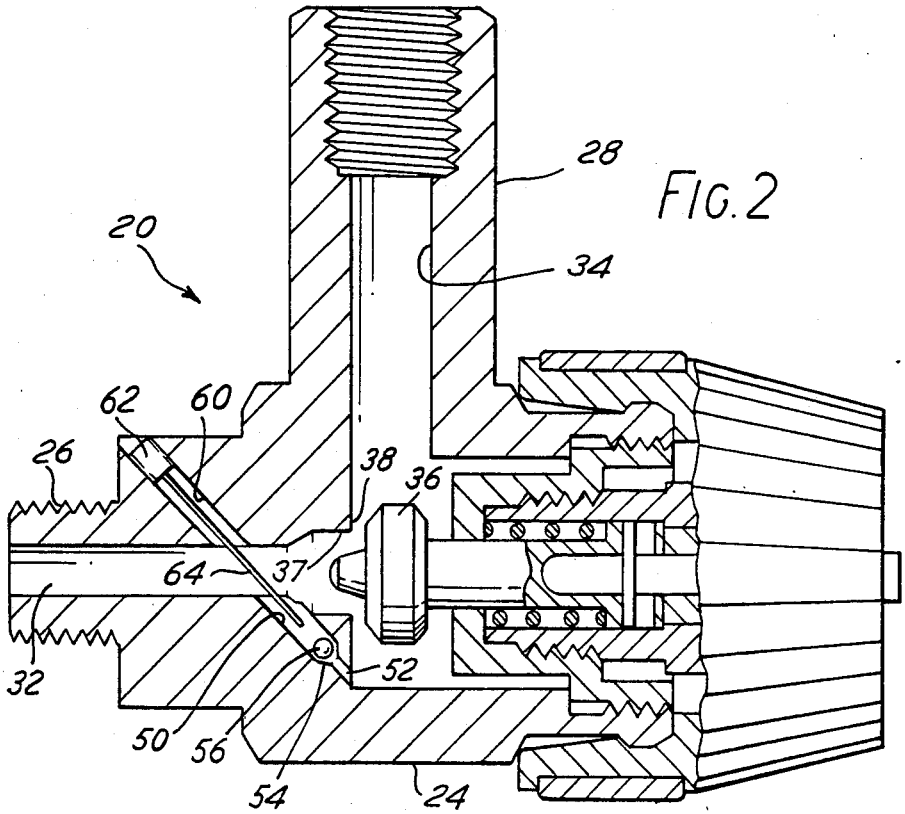

In the drawing:

FIG. 1 illustrates a steam type radiator in a one pipe type steam heating system to which the vent control unit of the present invention is applicable; and FIG. 2 is a sectional view of a vent control unit which embodies the invention.

Shown in FIG. 1 is a steam type radiator 10 which is useable with a one pipe type heating system.

In a one pipe type heating system, a boiler or other source of steam supplies steam through one pipe connected to a radiator during an "on" or supply period and drains condensate from the radiator to the boiler or other source through the same pipe at least during a subsequent "off" period.

The radiator 10 is connected to a boiler or other source of steam through a pipe 12 and condensate is returned from the radiator to the boiler or other source through the same pipe 12. A hand valve 14 which connects the radiator to the pipe 12 is not a control valve but is only for on-off operation for either connecting or disconnecting the radiator to or from the heating system.

A vent control unit 20 illustrated as being connected to the upper part of the radiator on the opposite side thereof from the pipe 12 includes a vent device 22 and a vent control valve 24 which is shown in detail in FIG. 2. Functionally, however, it is only necessary that the vent control unit 20 be somewhat above the valve 11 and the pipe 12 to be operative. Vent control unit 20 has a housing 24 with a horizontally extending threaded nipple 26 to enable its connection to the radiator 10 and a vertically extending internally threaded stub section 28 to which the vent device 22 is connected.

Vent control unit 20 is a self contained thermostatically controlled valve which includes fluid passage sections 32 and 34 between nipple 26 and stub section 28 to provide fluid communication between radiator 10 and the vent device 22. Vent control unit 20 also includes a thermostatically controlled closure member 36 cooperable with a valve seat 38 of an opening 37 for controlling the flow of air between passages 32 and 34.

It is only of importance relative to the invention that closure member 36 is thermostatically controlled in accordance with the ambient room temperature. The actual temperature sensing and sensing response and actuating mechanisms are not of specific interest relative to the invention hereof, however, and there is thus no specific disclosure thereof made herein.

The cycling time for a one pipe type heating system may typically include twenty minutes average "on" time and thirty minutes average "off" time. Starting with an "off" period, the steam in radiator 10 condenses during that time and the condensate returns to the boiler through pipe 12. The condensing of the steam creates a partial vacuum in the radiator and, if closure member 36 is open, air flows inwardly through vent device 22 and passages 34 and 32 to the interior of the radiator.

During the subsequent "on" period steam from the boiler, which may have a pressure on the order of 2 to 3 psig, has a tendency to flow into the radiator to the extent permitted by the existing air in the radiator. Depending upon the amount of heat called for by a room temperature sensing device (not shown), the thermostatically controlled closure member 36 permits air in the radiator steam to be displaced by the entering and vented through the opening 37 and vent device 22 at a controlled rate.

If all the air is completely evacuated from the radiator, the radiator becomes completely filled with steam and no further control by the closure member 36 is possible. In practice, however, the "on" period is made short enough so that normally all of the air in the radiator is not completely evacuated during the "on" period.

A problem with the vent control unit 20 as described above occurs when, due to a light heat demand, the closure member 36 is completely closed at the end of an on cycle. In that case the partial vacuum caused by the condensing of the steam in the radiator is prevented from drawing air through the vent device 22 into the radiator.

A first resulting disadvantage is that, with the absence of air in the radiator during the subsequent "on" period, there is no barrier to the entrance of steam through opening 37. The radiator immediately fills with steam and the maximum heat supply capability is effected during the "on" period. If on the other hand the radiator is filled with air at the beginning of the "on" period, as is desired, the thermostatically controlled closure member 36 operates to modulate the venting of air from the radiator to the vent device 22 in accordance with the heat requirements of the room.

A second resulting disadvantage experienced when the closure member 36 is closed at the end of the "on" period has to do with steam which is trapped in the passage 34 at the time when closure member 36 closes the opening 37. This trapped steam condenses during the "off" period and forms a pool of water at the bottom of passage 31 which covers the closure member 36. During the subsequent "on" period, air and/or steam admitted by closure member 36 through opening 37 flows through this pool of water and becomes heavily entrained with water. This leads to an undesireable spitting of water from the vent device during the "on" period when closure member 36 is open as a result of the thermostat calling for heat. The flow of air or steam through opening 37 during the "on" period also hinders the drawing of condensed water from passage 34 to the radiator.

The disadvantageous effects of closure member 36 being closed at the end of an "on" period are avoided by providing a sensitive check valve between passages 34 and 32 which opens towards passage 32.

The check valve can have various forms and as illustrated herein comprises a bore 50 in the body of valve 20 which provides fluid communication between passages 32 and 34 in parallel with the valve opening 39. Bore 50 has a smaller diameter section 52 which is utilized to form a ball seat 54 for a ball 56.

The check valve construction is facilitated by a bore 60 in line with bore 50 on the other side of passage 32. A sealing member 62 prevents leakage from the passage 32 and a rod 64 supported by the sealing member 62 extends into bore 50 to prevent the escape of ball 66 therefrom.

In operation it is only the check valve which allows the entry of air from the vent device to the radiator through passages 31 and 32 when opening 37 is closed by the closure member 36 during the "off" period. Thus during the next "on" period there will be a quantity of air in the radiator which can be modulatingly vented by the closure member 36 to control the entrance of steam into the radiator in accordance with the heat requirements of the room.

It is claimed:

1. A vent control unit for a radiator in a one pipe type steam heating system having on and off periods for supplying steam to said radiator, said vent control unit comprising, a housing having first and second fluid passages and a valve controllable opening between said passages, a thermostatically controllable valve unit mounted in said housing having a closure member cooperable with said opening to control the flow of a gaseous fluid from said first passage to said second passage, connecting means for attaching said unit to said radiator to provide fluid communication between the interior of said radiator and said first passage, a vent device, connecting means for attaching said vent device to said housing to provide fluid communication between said vent device and said second passage, and check valve means in said housing between said first and second passages bypassing said opening, said check valve means opening towards said second passage to allow the flow of air and condensate from said vent device to said radiator when said opening is closed by said closure member during one of said off periods.

* * * * *